US009802628B2

(12) United States Patent
Koerner et al.

(10) Patent No.: US 9,802,628 B2
(45) Date of Patent: Oct. 31, 2017

(54) ANTI-CLIMBING PROTECTION APPARATUS FOR A RAIL VEHICLE

(71) Applicant: SIEMENS AKTIENGESELLSCHAFT, Munich (DE)

(72) Inventors: Marcus Koerner, Grossinzemoos (DE); Alexander Trachtenherz, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/118,182

(22) PCT Filed: Feb. 11, 2014

(86) PCT No.: PCT/EP2014/052634

§ 371 (c)(1),
(2) Date: Aug. 11, 2016

(87) PCT Pub. No.: WO2015/120882

PCT Pub. Date: Aug. 20, 2015

(65) Prior Publication Data

US 2017/0174234 A1 Jun. 22, 2017

(51) Int. Cl.
*B61G 11/00* (2006.01)
*B61G 11/16* (2006.01)
(Continued)

(52) U.S. Cl.
CPC ..... *B61G 11/16* (2013.01); *B61D 15/06* (2013.01); *B61D 15/00* (2013.01); *B61G 11/18* (2013.01)

(58) Field of Classification Search
CPC ..... B61G 11/00; B61G 11/12; B61G 11/14; B61G 11/16; B61D 5/04; B61D 5/06; B61D 5/008
See application file for complete search history.

(56) References Cited

U.S. PATENT DOCUMENTS 8,783,479 B2 7/2014 Ewerding
2008/0236440 A1* 10/2008 Nakamura ..... B61D 15/06 105/392.5

(Continued)

FOREIGN PATENT DOCUMENTS

CN 101553390 A 10/2009
CN 102464002 A 5/2012

(Continued)

*Primary Examiner* — Jason C Smith
(74) *Attorney, Agent, or Firm* — Laurence Greenberg; Werner Stemer; Ralph Locher

(57) ABSTRACT

An anti-climbing protection apparatus for a rail vehicle includes at least one buffer supported by an energy absorption element connected to a rail vehicle frame. In order to permit such a protection apparatus to be produced economically, to reliably prevent overriding and to be comparatively easy to retrofit, a bearing element is fastened to an end of the energy absorption element facing away from the vehicle frame. The bearing element supports an anti-climbing protection device at an end thereof protruding in a vertical direction from the buffer. In the event of a crash, a horizontally oriented stop, in cooperation with the front of the rail vehicle, permits an anti-climbing protection element of the anti-climbing protection device to be brought from the stop into an anti-climbing protection position extending outward over the buffer.

15 Claims, 11 Drawing Sheets

(51) Int. Cl.

| | |
|---|---|
| ***B61D 15/06*** | (2006.01) |
| *B61D 15/00* | (2006.01) |
| *B61G 11/18* | (2006.01) |

(56) References Cited

U.S. PATENT DOCUMENTS

| | | | | |
|---|---|---|---|---|
| 2008/0314282 | A1* | 12/2008 | Malfent | B61D 15/06 105/392.5 |
| 2009/0000506 | A1 | 1/2009 | Jaede | |
| 2010/0218701 | A1* | 9/2010 | Graf | B61D 15/06 105/392.5 |
| 2012/0325108 | A1* | 12/2012 | Graf | B61F 1/10 105/392.5 |
| 2013/0126458 | A1* | 5/2013 | Ewerding | B61G 7/00 213/7 |
| 2013/0233200 | A1* | 9/2013 | Taguchi | B61D 15/06 105/392.5 |
| 2016/0023672 | A1* | 1/2016 | Koerner | B61D 15/06 213/221 |
| 2016/0214629 | A1* | 7/2016 | Drexler | B61G 11/16 |
| 2016/0318528 | A1* | 11/2016 | Westman | B61G 9/24 |
| 2016/0347333 | A1* | 12/2016 | Lenzi | B61G 11/18 |

FOREIGN PATENT DOCUMENTS

| | | | |
|---|---|---|---|
| DE | 3228942 | A1 | 2/1984 |
| DE | 20118262 | U1 | 3/2003 |
| DE | 102006050028 | A1 | 4/2008 |
| DE | 102008048244 | B3 | 9/2009 |
| DE | 102008048247 | B3 | 9/2009 |
| EP | 0952062 | B1 | 8/2005 |
| EP | 2033868 | A1 | 3/2009 |
| EP | 2594452 | A1 | 5/2013 |

* cited by examiner

ANTI-CLIMBING PROTECTION APPARATUS FOR A RAIL VEHICLE

BACKGROUND OF THE INVENTION

Field of the Invention

The invention relates to an anti-climbing protection apparatus for a rail vehicle comprising at least one buffer which is supported by an energy absorption element connected to a vehicle frame of the rail vehicle.

An anti-climbing protection apparatus of this type is described in the German patent specification DE 10 2008 048 247 B3. The known anti-climbing protection apparatus has support elements extending in a longitudinal direction of a rail vehicle that is formed by a locomotive, said support elements being interconnected via a transverse support. The support elements are so arranged above the buffers on the locomotive frame or chassis as to be displaceable via guides, and extend as far as an end region of an elastic path of the buffer plates of the buffers. Thrust bearings, against which a solid structure of a colliding rail vehicle comes to bear in the event of a crash, are provided at the end of the support elements. The known anti-climbing protection apparatus requires a special construction of a rail vehicle or locomotive, and is therefore not suitable for retrofitting.

The European patent specification EP 2 033 868 B1 also discloses an anti-climbing protection apparatus in the form of a so-called buffer anti-climbing protection device, in which a funnel-shaped shell of rigid material is provided for each of the two buffers at the ends of a rail vehicle, and is so fastened to the vehicle frame as to overhang the respective buffer. The known buffer anti-climbing protection device preferably has two shell sections, these being formed as protruding catches. In the event of a crash, the buffer of an oncoming vehicle goes into the funnel-shaped shell, thereby preventing the buffer from overriding. If two rail vehicles having identically protected buffers collide, it cannot be excluded that one of the two shells, by virtue of its shape, could necessarily cause a degree of climbing and hence derailment of one or both rail vehicles.

The unexamined German patent application DE 10 2006 050 028 A1 also discloses an anti-climbing protection apparatus for rail vehicles, in which the rail vehicles have projecting shaped parts at the front of the vehicle. In the event of two rail vehicles colliding, these produce a positive engagement between the vehicle fronts impacting each other. A matrix of cells made from flat plates is provided at the front of each vehicle in this case, said cells being open in the direction of travel, wherein the intersection points thereof have greater rigidity in a longitudinal direction and the webs thereof have less rigidity in a longitudinal direction. When a collision occurs, the vehicle front of one of the rail vehicles penetrates the vehicle front of the other rail vehicle, resulting in interlocking in both vertical and horizontal directions. This anti-climbing protection apparatus does not function if the colliding vehicles are equipped with dissimilar anti-climbing protection apparatus, and therefore cannot be used in the context of interoperable transport.

BRIEF SUMMARY OF THE INVENTION.

The object of the invention is to specify an anti-climbing protection apparatus of the type cited in the introduction, wherein said anti-climbing protection apparatus can be produced economically, reliably prevents overriding and can easily be retrofitted.

In order to achieve this object, as part of an anti-climbing protection apparatus of the type cited above, a bearing element is inventively fastened to that end of the energy absorption element which faces away from the vehicle frame, wherein said bearing element supports an anti-climbing protection device at its end which projects in a vertical direction from the buffer, and a horizontally aligned stop is provided in such a way that an anti-climbing protection element of the anti-climbing protection device, interacting with the vehicle front of the rail vehicle in the event of a crash, can be moved by said stop into an anti-climbing protection position which extends over the buffer element.

An important advantage of the inventive anti-climbing protection apparatus is that it is relatively economical to produce because it consists essentially of only the bearing element with the anti-climbing protection device and the stop, and its main parts can therefore be preproduced in series; installation into the rail vehicle is relatively easy to manage. A further advantage of the inventive anti-climbing protection apparatus is that it can easily be retrofitted to rail vehicles because the attachment of the bearing element with the anti-climbing protection device can be effected at the free end of the energy absorption element and the fastening of the stop can be effected at the vehicle frame. Consequently, no significant intervention is required in the rail vehicle or the front thereof.

With regard to the inventive anti-climbing protection apparatus, the stop can be arranged in various ways. It may be advantageous to fasten the stop in the region of the vehicle front of the rail vehicle. This does not require any expensive supplementary work on the rail vehicle because the stop can readily be attached to the vehicle front.

However, it is also possible to fasten the stop to the anti-climbing protection element. In this case, the inventive anti-climbing protection apparatus including the stop can be entirely preproduced, and it is merely necessary to ensure that a suitably mechanically stable region is provided for the stop on the rail vehicle or its vehicle frame.

Concerning the attachment of the stop and the anti-climbing protection device in relation to the energy absorption element or the buffer of the rail vehicle, various possibilities exist. In order to prevent the opposing vehicle from overriding in the event of a collision, the stop and the anti-climbing protection device are arranged above the energy absorption element.

In order to prevent the local vehicle from overriding in the event of a collision, the stop and the anti-climbing protection device are arranged below the energy absorption element.

In order to prevent the opposing vehicle and the local vehicle from overriding in the event of a collision, the anti-climbing protection entities are arranged both above and below the energy absorption element.

With regard to the inventive anti-climbing protection apparatus, the anti-climbing protection element can be designed in different ways. In an embodiment which is considered advantageous, the anti-climbing protection element is a slider which is so held in a guide of the anti-climbing protection device as to be horizontally displaceable and which, at its end facing the stop, projects from the guide. This embodiment of the anti-climbing protection element is considered to be advantageous due to its functional safety and comparative ease of implementation.

In order to increase the reliability of the inventive anti-climbing protection apparatus, the slider can be arrested in the initial operating position in order to prevent unwanted slipping, e.g. by means of a break-off connection between the slider and the guide. Only if the stop exerts a horizontal force on the slider, as normally occurs in the event of a crash, does the break-off connection break and the slider can be moved by means of the stop into the anti-climbing protection position. Unwanted slipping of the slider during normal operation is prevented by the break-off connection.

A further functional improvement can be achieved by equipping the slider of the anti-climbing protection device with an additional horizontal rib at its end which faces away from the stop. As a result of this, the local vehicle can also "interlock" with a correspondingly embodied vehicle front of the opposing vehicle in the event of a collision.

In order to increase the reliability of the inventive anti-climbing protection apparatus by locking the anti-climbing protection element in the anti-climbing protection position in the event of a crash, in an advantageous embodiment, the anti-climbing protection element is a slider element which is connected in a longitudinally offset manner via a rated break point to a slider part that faces the stop, and the slider part is connected via a further rated break point to the guide, wherein the one rated break point between the slider part and the slider element is stronger than the further rated break point between the slider part and the guide. It is thereby ensured that overriding is prevented in the event of a crash, while unwanted slipping is prevented in the initial operating position during normal operation.

Concerning the embodiment of the slider element and the slider part, various possibilities exist. It is considered advantageous, for example, for the slider element and the slider part to be so designed as to have a constant thickness over their length in each case. This embodiment has the advantage that, in addition to the above cited safety, ease of manufacture is assured for the slider element and the slider part.

As an alternative to the embodiment described above, provision can be made for the slider part to widen in the shape of a wedge towards the stop, and for the slider element to have a reverse widening. In this case, the slider element and the slider part interact to form a wedge-shaped connection, by means of which positive fixing in the guide is effected as soon as the anti-climbing protection position is reached. By virtue of said fixing, the slider element is secured in the anti-climbing protection position against displacement due to any possible horizontal force effects caused by a collision.

Irrespective whether the anti-climbing protection element is a slider or a slider part, it is considered advantageous for the slider or the slider element of the inventive anti-climbing protection apparatus to be equipped with a catch at its end which faces away from the stop.

In a further embodiment variant of the inventive anti-climbing protection apparatus, the anti-climbing protection device is designed as a pivoting bracket which is pivotably mounted via one of its bracket arms on a rocker joint of the bearing element, said rocker joint being situated below the energy absorption element, and is embodied at that end of the bearing element which is situated above the energy absorption element in such a way that its other bracket arm can be pivoted and locked into the anti-climbing protection position by means of the stop on the rail vehicle in the event of a crash. It is considered a significant advantage of this embodiment variant that it reliably prevents overriding and is easy to retrofit.

BRIEF DESCRIPTION OF THE SEVERAL VIEWS OF THE DRAWING

The invention is further explained in the drawings, in which.

DESCRIPTION OF THE INVENTION

Figure 1:
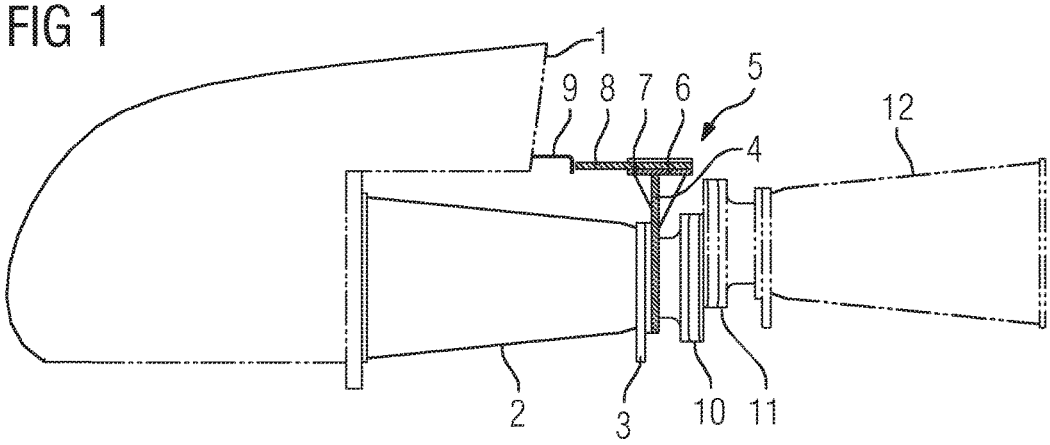
FIGS. 1 to 3 show a first exemplary embodiment of the inventive anti-climbing protection apparatus comprising a slider arranged above the energy absorption element, in various positions during different stages of a crash.
Figure 2:
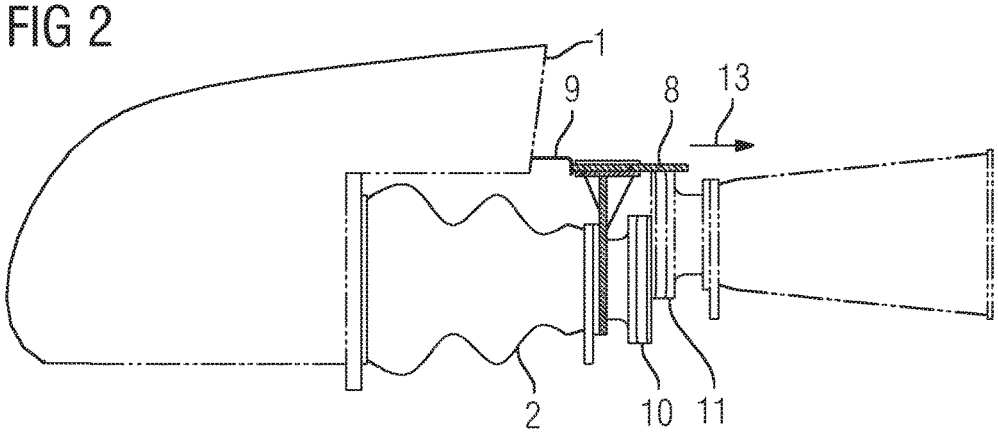
Figure 3:
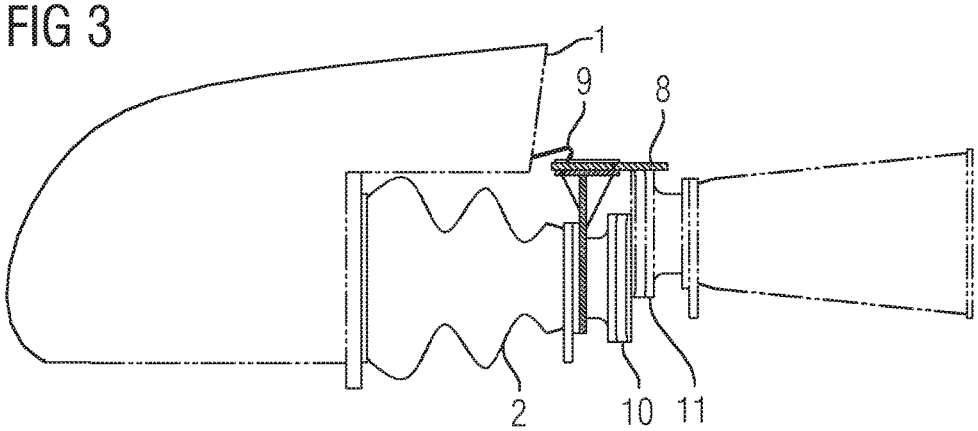

FIGS. 1 to 3, in which corresponding elements are denoted by the same reference signs, schematically show a vehicle frame 1 of a rail vehicle which is not shown in further detail. Attached to the vehicle frame 1 is an energy absorption element 2 having a bearing element 4 at its end 3 which faces away from the vehicle frame 1. The bearing element 4 supports an anti-climbing protection device 5 that has a guide 6 in which a slider 8 is held by means of a break-off connection 7. At its left-hand end in FIGS. 1 to 3, the slider 8 is located directly in front of or abuts a stop 9 which is fastened to the vehicle frame 1.

FIGS. 1 to 3 also show that a buffer 10 is held in the energy absorption element 2 in a conventional manner, wherein said buffer 10 faces a buffer 11 of an opposing vehicle in the event of a crash. This buffer 11 is guided and/or held in an energy absorption element 12 directly in the opposing vehicle.

FIG. 1 shows a state in which the buffers 10 and 11 of two rail vehicles abut with a vertical offset, as occurs during operation when rail vehicles come together in a normal manner.

If the rail vehicle having the vehicle frame 1 and the buffer 10 are pressed against the buffer 11 of the opposing vehicle in the event of a crash, as illustrated in FIG. 2, the energy absorption element 2 is first compressed and thereby shortened in length. At the same time, the stop 9 is pushed against the slider 8 of the anti-climbing protection device 5, the break-off connection 7 being severed and the slider 8 being shifted in the direction of the arrow 13. In this way, the slider 8 is moved into an anti-climbing protection position, this being produced by virtue of the slider 8 sliding over the buffer 11 of the opposing vehicle and thereby preventing any overriding of the buffer 11 and the opposing vehicle connected thereto.

FIG. 3 shows that during the course of the crash the energy absorption element 2 is compressed even further than is illustrated in FIG. 2, whereby the vehicle frame 1 comes even closer to the vehicle frame of the opposing vehicle (not shown) and the buffer 11, the stop 9 being then deformed or broken off depending on the design.

Figure 4:
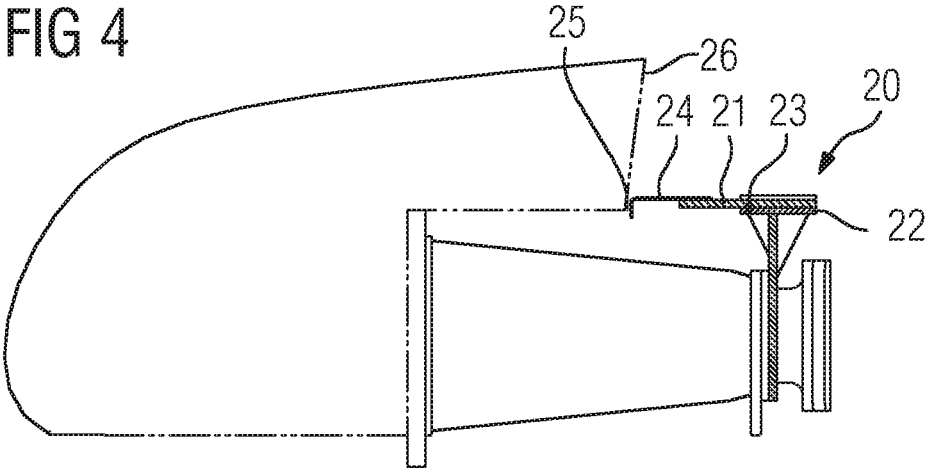
FIG. 4 shows a further exemplary embodiment of the inventive anti-climbing protection apparatus comprising a stop on the slider, inventive anti-climbing protection apparatus comprising an additional horizontal rib on that end of the slider which faces away from the stop.

In the case of the exemplary embodiment of the inventive anti-climbing protection apparatus according to FIG. 4, an anti-climbing protection device 20 is used which again features a slider 21 in a guide 22. The slider 21 is again connected to the guide 22 by means of a rated break point 23. Unlike the exemplary embodiment according to FIGS. 1 to 3, a stop 24 is attached to the slider 21 in this exemplary embodiment and, in the event of a crash, is pushed against a front region 25 of the vehicle frame 26 of the rail vehicle, which is likewise not illustrated in detail here.

The operation of this anti-climbing protection device otherwise corresponds exactly to that explained in detail with reference to FIGS. 1 to 3, and a detailed description thereof is therefore omitted here in order to avoid repetition.

Figure 5:
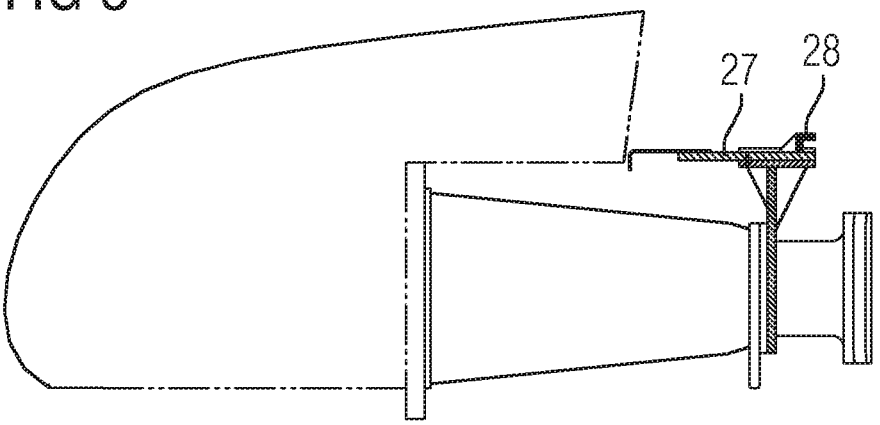

This applies likewise to the exemplary embodiment according to FIG. 5, which differs from the exemplary embodiment according to FIG. 4 only in that a slider 27 features an additional horizontal rib 28 by means of which the slider 27 can also "interlock" (in a manner which is not shown) with a correspondingly embodied vehicle front of the opposing vehicle.

Figure 6:
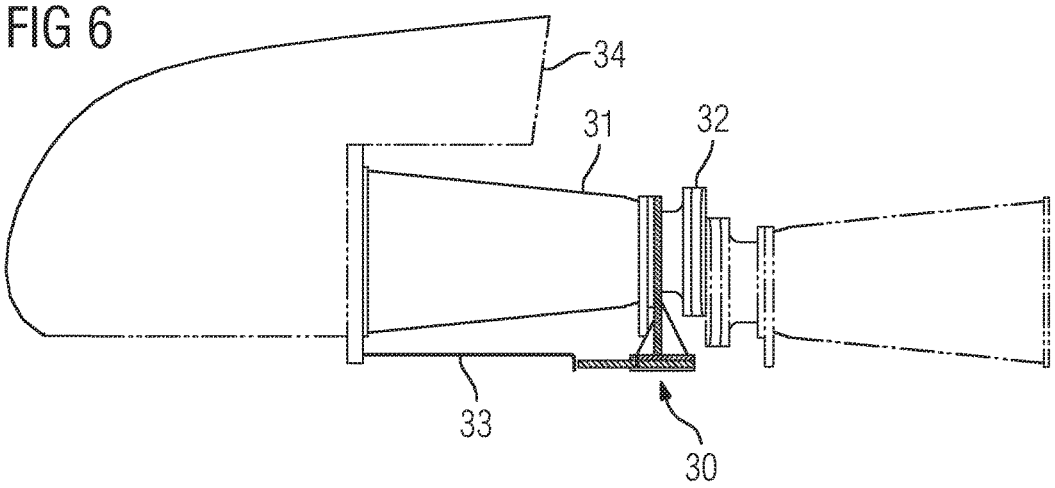
FIGS. 6 to 8 show a further exemplary embodiment of the inventive anti-climbing protection apparatus comprising a slider arranged below the energy absorption element, during different stages of a crash.

The exemplary embodiment according to FIGS. 6 to 8 corresponds largely to the exemplary embodiment according to FIGS. 1 to 3, differing in that an anti-climbing protection device 30 here is located vertically below an energy absorption element 31 or a buffer 32. A stop 33 here is likewise attached to the vehicle frame 34 in a different, low region. FIG. 6 illustrates the anti-climbing protection apparatus in the normal state.

Figure 7:
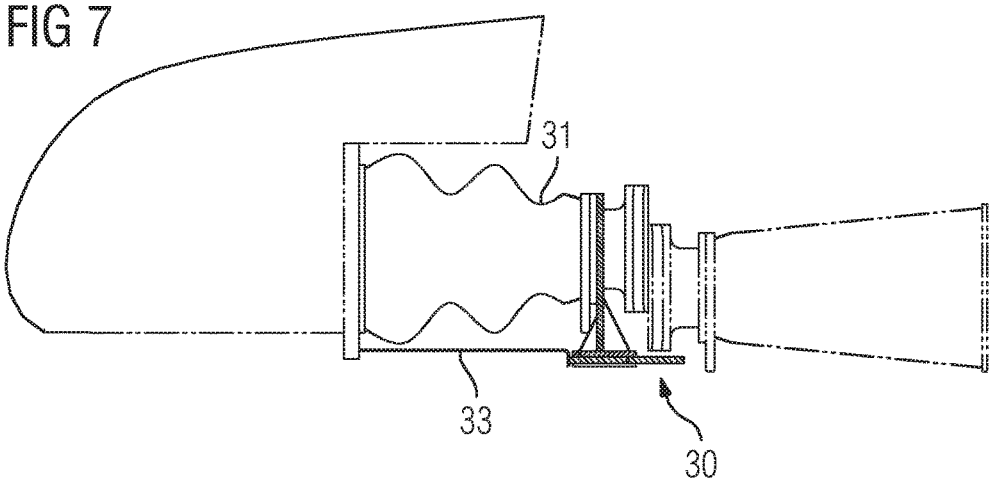
Figure 8:
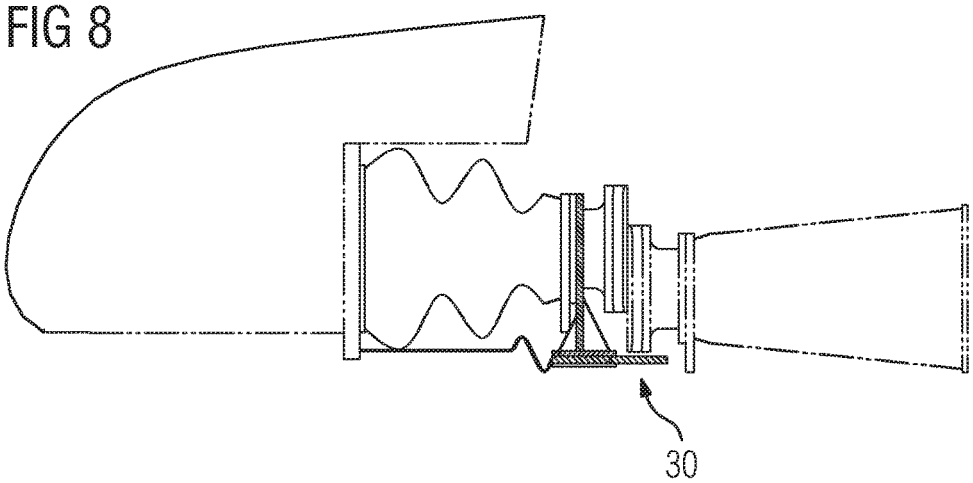

FIGS. 7 and 8 show the various states in the event of a crash, wherein the states according to FIGS. 7 and 8 correspond analogously to FIGS. 2 and 3.

The exemplary embodiment of the inventive anti-climbing protection apparatus illustrated in various states in FIGS. 9 to 12 has an anti-climbing protection device 40 which is again supported by a bearing element 41. The bearing element 41 is in turn attached to that end 43 of an energy absorption element 44 which faces away from a vehicle frame 42.

The anti-climbing protection device 40 here has an anti-climbing protection element in the form of a slider element 45 which is guided in a guide 46. As shown in the magnified illustration of the anti-climbing protection device 40 according to FIG. 10, the slider element 45 is connected in a longitudinally offset manner by means of a rated break point 47 to a slider part 48, which itself is fastened via a further rated break point 49 to the guide 46. At its left-hand end as shown in FIGS. 9 to 12, the slider part 48 is located directly in front of or abuts a stop 50 which is fastened to the vehicle frame 42. The slider part 48 is so designed as to be sectionally wedge-shaped relative to the slider element 45. A buffer 51 is held in a sprung manner in the energy absorption element 44.

Figure 9:
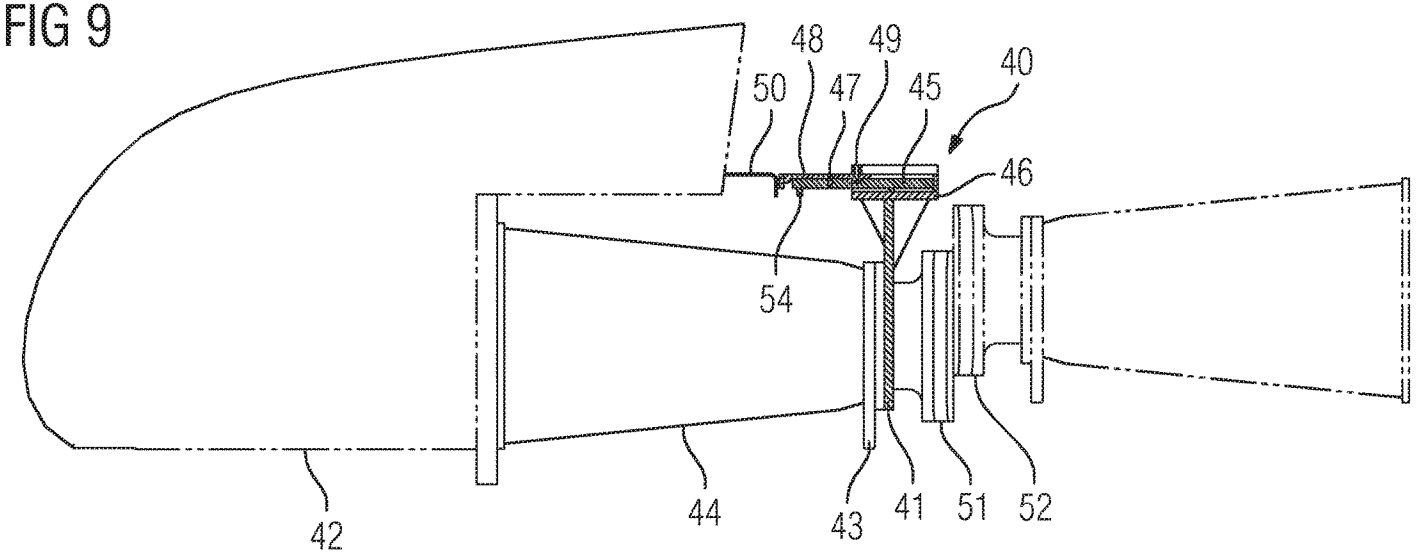
FIGS. 9 to 12 show a further exemplary embodiment of the inventive anti-climbing protection apparatus comprising a slider part and a slider element having constant thickness.
Figure 10:
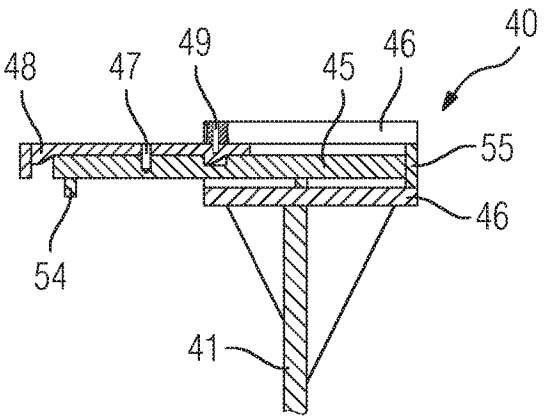

If a crash with an opposing vehicle having a buffer 52 as shown in FIG. 9 occurs, a compression of the energy absorption element 44 initially takes place here again, the distance of the bearing element 41 from the vehicle frame 42 being shortened. The slider part 48 is thereby pushed in the direction of the arrow 53 by means of the stop 50, severing the further rated break point 49, and the slider element 45 is carried along with it. In this case, the latter slides into the anti-climbing protection position over the buffer 52, its catch 55 behind the buffer 52 of the opposing vehicle which is not otherwise illustrated (cf. FIGS. 10 and 12), and is arrested in this position by its stop 54.

Figure 11:
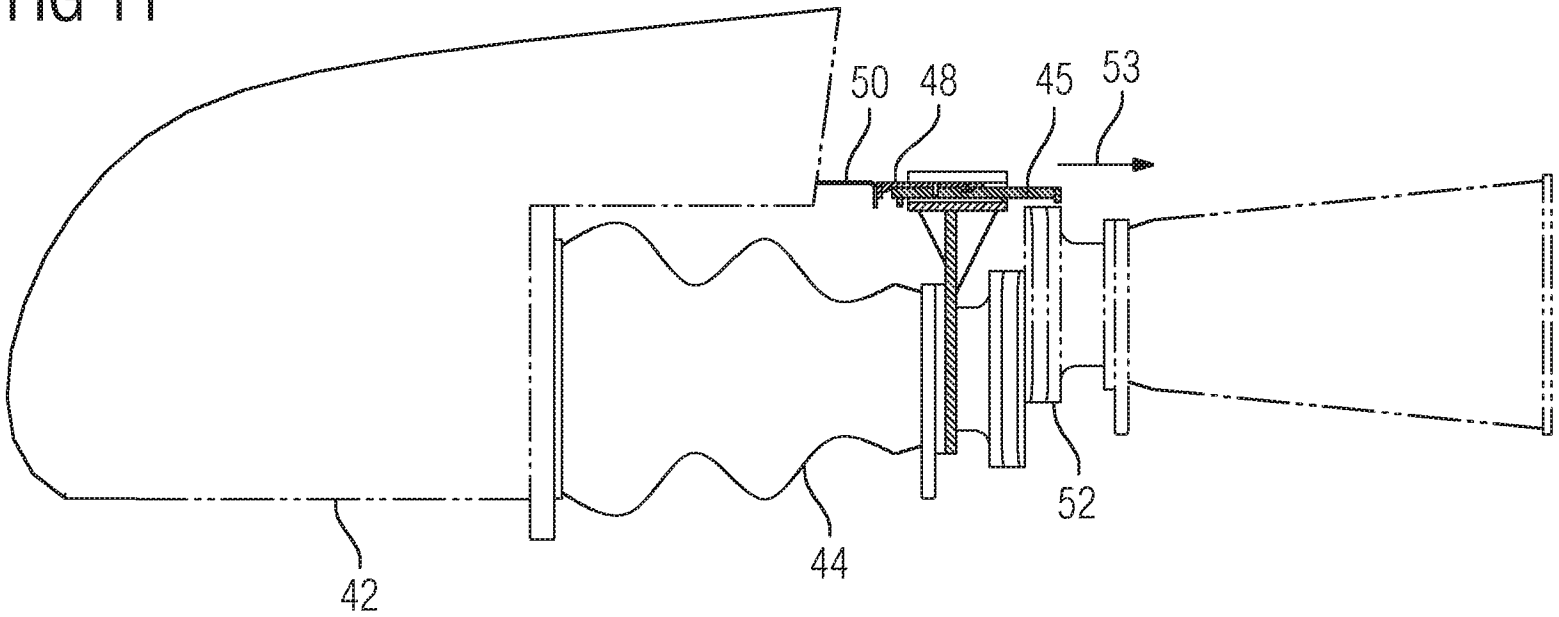
Figure 12:
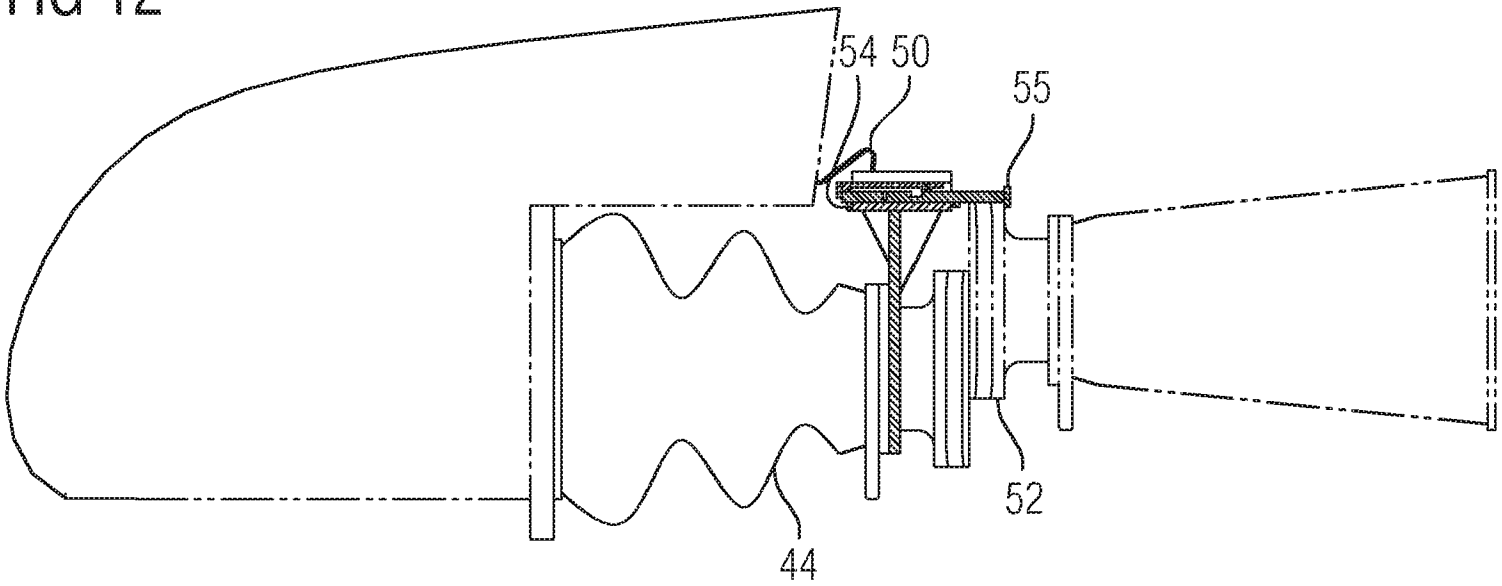
Figure 13:
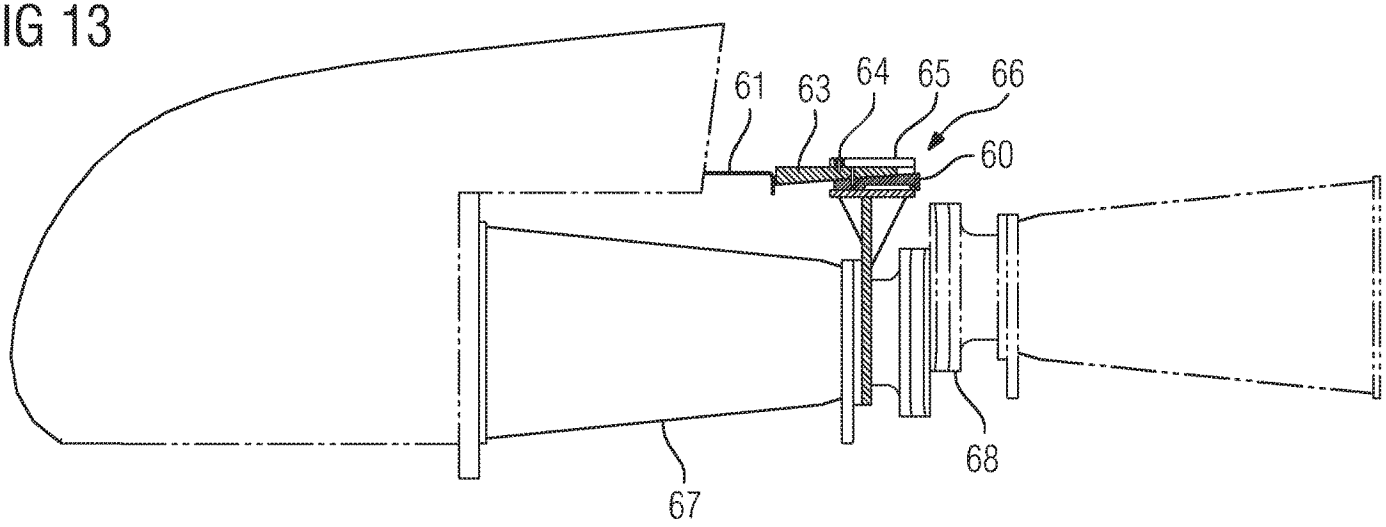
FIGS. 13 to 16 show an exemplary embodiment comprising a wedge-shaped slider element and a wedge-shaped slider part.

During the further course of the supposed crash (see FIG. 12), the energy absorption element 44 is compressed even further as shown in FIG. 11. In this context, the slider part 48 is pushed further in the direction of the arrow 53 by means of the stop 50, severing the rated break point 47, until the slider part 48 and the slider element 45 are jammed together in the guide 46. The rated break point 47 is so designed as to be stronger than the rated break point 49.

During the further course of a supposed crash, the stop 50 is deformed in a plastic manner or broken. The slider element 45 with its catch 55 prevents overriding of the opposing vehicle, and is secured in the guide 46 against backward displacement due to any possible horizontal force effects caused by the collision.

The exemplary embodiment of the inventive anti-climbing protection apparatus shown in FIGS. 13 to 16 differs from the exemplary embodiment according to FIGS. 9 to 12 in that a slider element 60 here is designed in the shape of a wedge, this decreasing in width towards a stop 61, and is securely connected to a slider part 63 via a rated break point 62. Said slider part 63 is likewise designed in the shape of a wedge, but increases in width towards the stop 61 and is connected via a further rated break point 64 to the guide 65.

Figure 14:
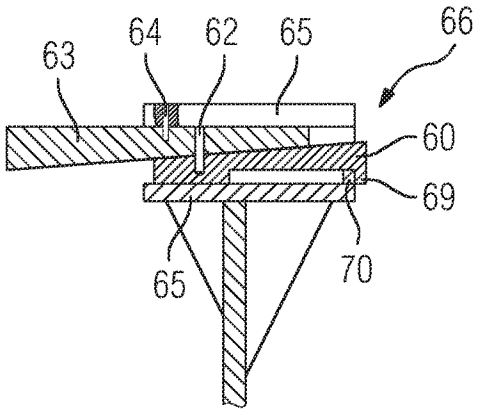

If a crash occurs, an energy absorption element 67 is compressed and the stop 61 is pressed against the slider part 63 in this case. The rated break point 64 is severed first in this case, because it is weaker than the further rated break point 62. The slider element 60 with its catch 69 is pushed as far as the stop 70, and slides over a buffer 68 of an opposing vehicle which is not illustrated further (see in particular FIG. 14 showing a magnified illustration of the anti-climbing protection apparatus 66).

Figure 15:
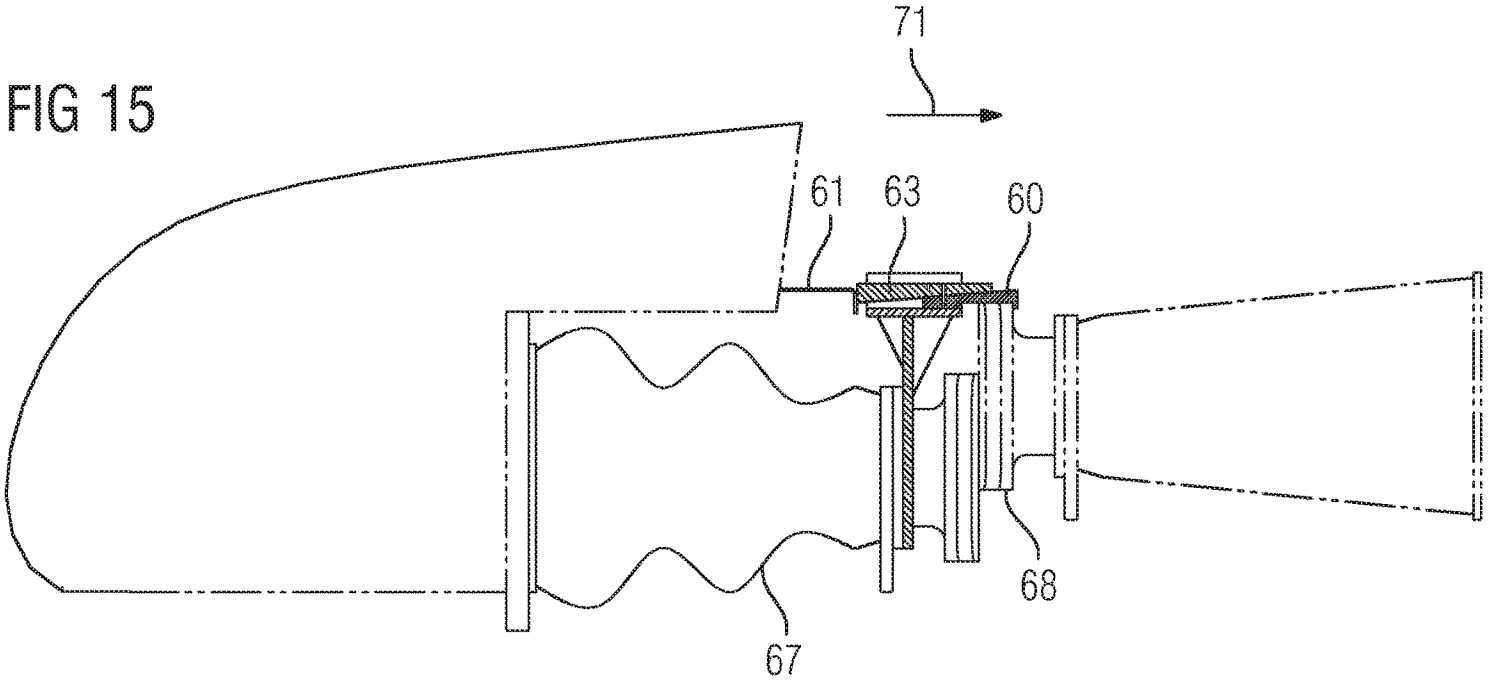
Figure 16:
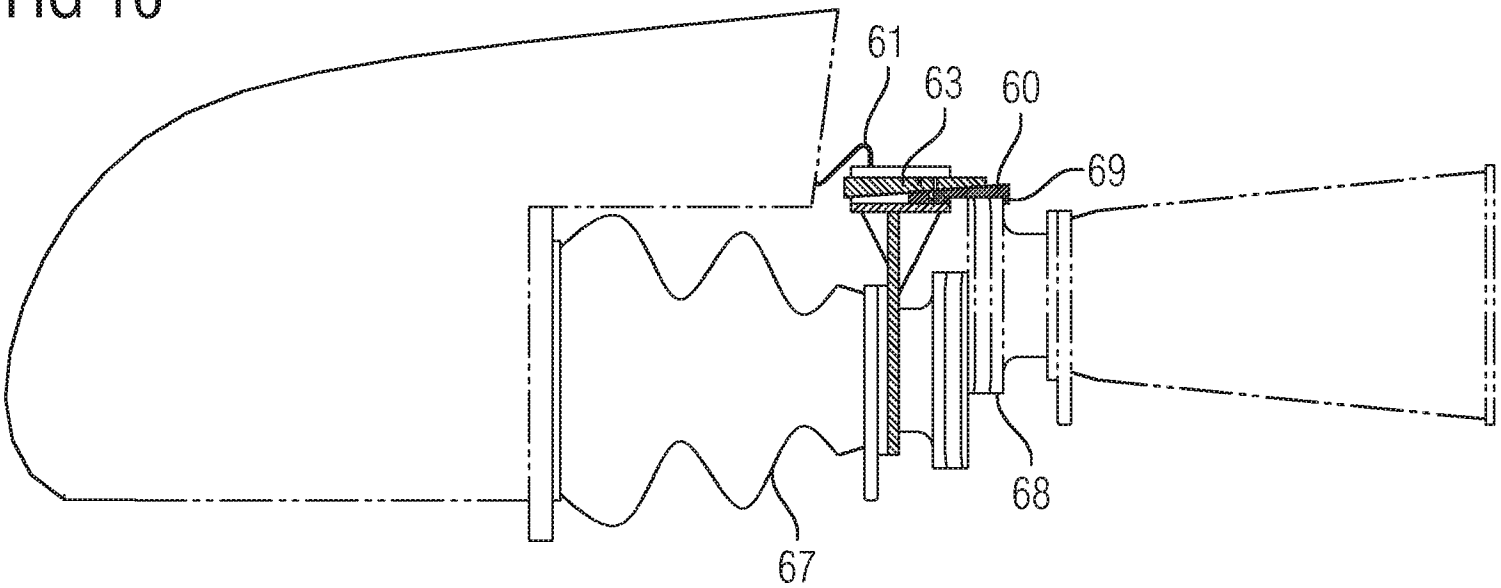

It can be seen from FIG. 15 that the energy absorption element 67 is compressed even further during the crash. In this context, the slider part 63 is pushed further in the direction of the arrow 71 by means of the stop 61, severing the rated break point 62, until it is jammed together with the slider element 60 in the guide 65. During the further course of the supposed crash, the energy absorption element 67 is further compressed as shown in FIG. 16. In this context, the stop 61 is deformed in a plastic manner or broken. The slider element 60 with its catch 69 prevents overriding of the opposing vehicle, and is secured in the guide 65 against backward displacement due to any possible horizontal force effects caused by the collision.

Figure 17:
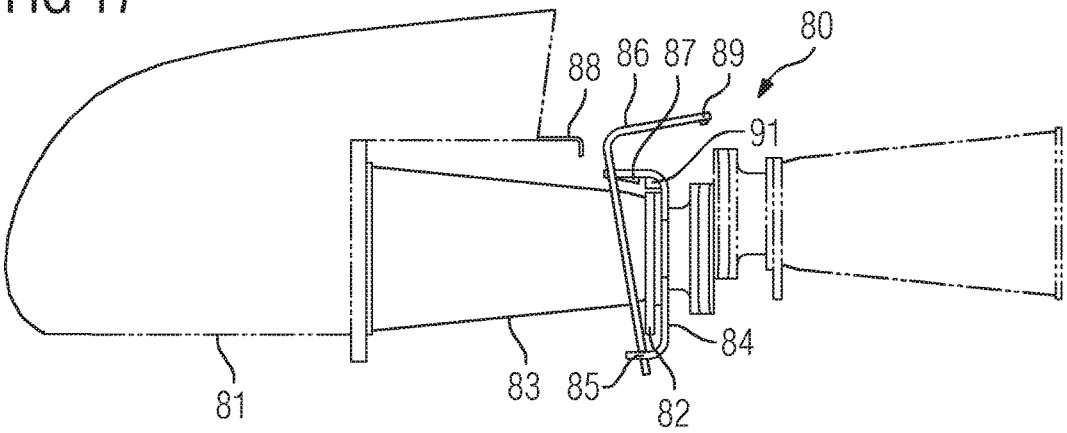
FIGS. 17 to 19 show an exemplary embodiment comprising a pivoting bracket as an anti-climbing protection element.
Figure 18:
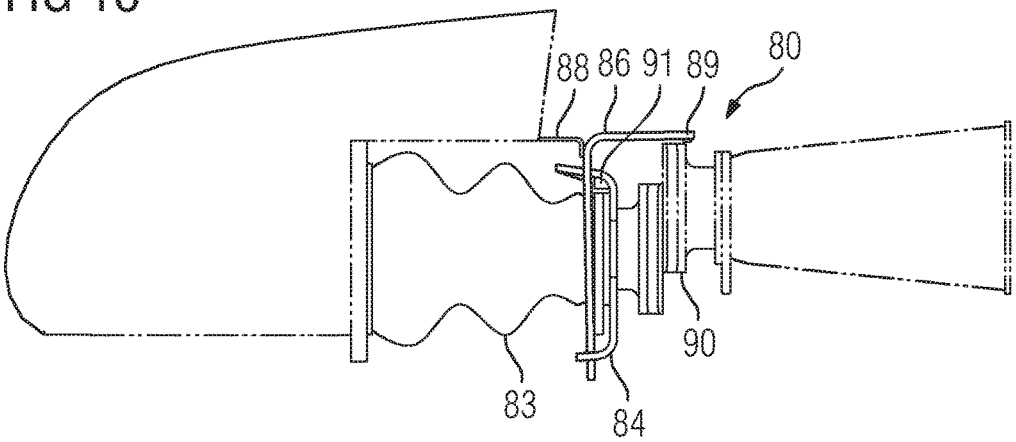
Figure 19:
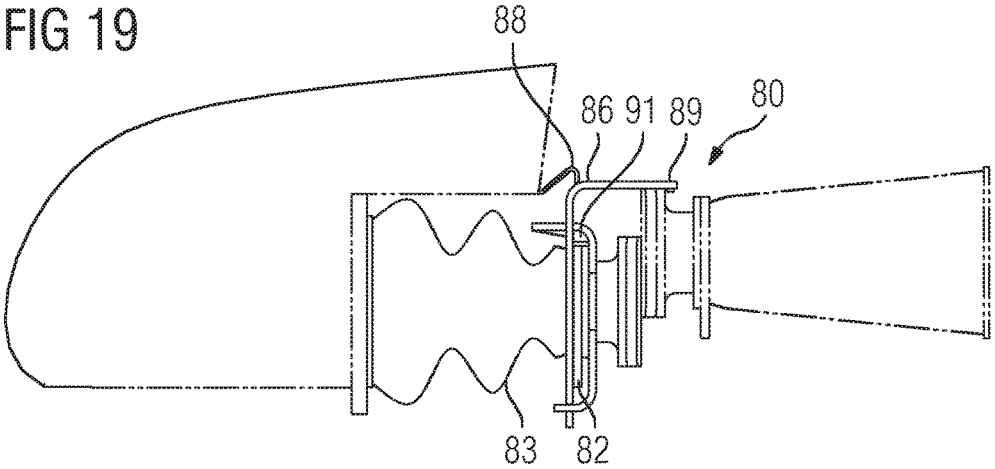

FIGS. 17 to 19 show a further exemplary embodiment of the inventive anti-climbing protection apparatus in various positions during a crash.

In this case, FIG. 17 shows the initial position, i.e. before the crash, of an anti-climbing protection apparatus, here comprising an anti-climbing protection device 80 which is again attached to that side 82 of an energy absorption element 83 which faces away from a vehicle frame 81. Specifically, a bearing element 84 is attached to this end of the energy absorption element 83 and has a rocker joint 85, by means of which a pivoting bracket 86 is pivotably mounted, below the energy absorption element. A locking wedge 87 is formed on the bearing element 84 above the energy absorption element 83, and is connected to said bearing element 84 in a flexionally elastic manner. A stop 88 which is fastened to the vehicle frame 81 is situated opposite the pivoting bracket 86.

As shown in FIG. 18, compression of the energy absorption element 83 occurs in the event of a crash, whereby the stop 88 is pushed against the pivoting bracket 86 and tilts the latter at the rocker joint 85 into the anti-climbing protection position as far as a stop 91 at the locking wedge 87. In this case, a lever arm comprising the locking wedge 87 of the support element 84 is pushed up in an elastic manner and locks the pivoting bracket 86 as soon as the anti-climbing protection position is reached at the stop 91. In the anti-climbing protection position, the pivoting bracket 86 with its bracket arm 89 is positioned over a buffer 90 of an opposing vehicle which is not shown further.

FIG. 19 shows that the energy absorption element 83 is compressed even further during the further course of the supposed crash. In this context, the stop 88 is deformed in a plastic manner or broken. The pivoting bracket 86 with its bracket arm 89 prevents the overriding of the opposing vehicle and is secured against backward displacement in its anti-climbing protection position by the locking wedge 87.

Figure 20:
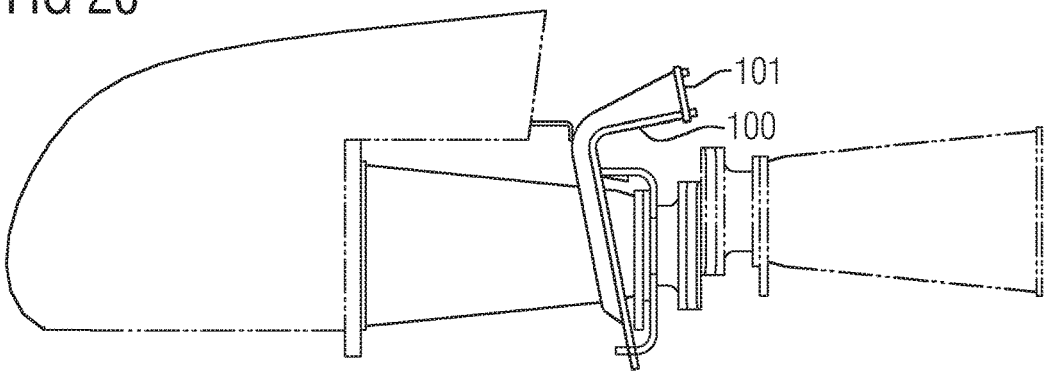
FIG. 20 shows a further exemplary embodiment comprising a pivoting bracket which is embodied with an additional horizontal rib at that end of the pivoting bracket which faces away from the stop.

The anti-climbing protection apparatus shown in FIG. 20 differs from the anti-climbing protection apparatus illustrated in FIGS. 17 to 19 in that additional horizontal ribbing 101 is provided on a pivoting bracket 100, by means of which vertical deviation is prevented in the event of a crash with a vehicle which is structurally identical or which has a vehicle front that is configured correspondingly.

The invention claimed is:

1. An anti-climbing protection apparatus for a rail vehicle, the anti-climbing protection apparatus comprising:

an energy absorption element connected to a vehicle frame of the rail vehicle and having an end facing away from the vehicle frame;

at least one buffer supported by said energy absorption element;

a bearing element fastened to said end of said energy absorption element facing away from the vehicle frame, said bearing element having an end projecting vertically from said at least one buffer;

an anti-climbing protection device supported by said end of said bearing element projecting vertically from said at least one buffer, said anti-climbing protection device including an anti-climbing protection element; and a horizontally aligned stop moving said anti-climbing protection element interacting with the front of the rail vehicle into an anti-climbing protection position extending over said at least one buffer in the event of a crash.

2. The anti-climbing protection apparatus according to claim 1, wherein said stop is fastened in a vicinity of the front of the rail vehicle.

3. The anti-climbing protection apparatus according to claim 1, wherein said stop is fastened to said anti-climbing protection device.

4. The anti-climbing protection apparatus according to claim 1, wherein said stop and said anti-climbing protection device are disposed above said energy absorption element.

5. The anti-climbing protection apparatus according to claim 4, wherein:

said bearing element includes a rocker joint disposed below said energy absorption element and an end disposed above said energy absorption element;

said anti-climbing protection device includes a pivoting bracket having two bracket arms and being pivotably mounted via one of said bracket arms on said rocker joint of said bearing element; and said pivoting bracket is supported at said end of said bearing element disposed above said energy absorption element permitting the other of said bracket arms to be moved into said anti-climbing protection position by said stop on the rail vehicle in the event of a crash.

6. The anti-climbing protection apparatus according to claim 1, wherein said stop and said anti-climbing protection device are disposed below said energy absorption element.

7. The anti-climbing protection apparatus according to claim 1, wherein said anti-climbing protection device includes a guide, and said anti-climbing protection element is a slider being held in said guide, being horizontally displaceable in said guide and having an end facing said stop and projecting from said guide.

8. The anti-climbing protection apparatus according to claim 7, wherein said slider is arrested against unwanted slipping in an initial operating position.

9. The anti-climbing protection apparatus according to claim 7, which further comprises a break-off connection holding said slider in said guide.

10. The anti-climbing protection apparatus according to claim 7, wherein said slider has an end facing away from said stop and a horizontal rib at said end facing away from said stop.

11. The anti-climbing protection apparatus according to claim 7, wherein said slider or said slider element has an end facing away from said stop and a catch at said end.

12. The anti-climbing protection apparatus according to claim 1, which further comprises:

a slider part facing said stop;

said anti-climbing protection element being a slider element connected in a longitudinally offset manner through one rated break point to said slider part;

said slider part being connected through a further rated break point to said guide; and said one rated break point being stronger than said further rated break point.

13. The anti-climbing protection apparatus according to claim 12, wherein said slider element and said slider part have a constant thickness over their length and are correspondingly wedge-shaped in sections.

14. The anti-climbing protection apparatus according to claim 12, wherein said slider part widens in a wedge shape towards said stop and said slider element widens in a wedge shape away from said stop.

15. The anti-climbing protection apparatus according to claim 12, wherein said slider or said slider element has an end facing away from said stop and a catch at said end.

* * * * *